US011347166B2

(12) United States Patent
Yamaguchi et al.

(10) Patent No.: US 11,347,166 B2
(45) Date of Patent: May 31, 2022

(54) BELT UNIT INCLUDING FIRST FRAME PROVIDED WITH BEARING HOLDER POSITIONED CLOSER TO SECOND FRAME, AND IMAGE-FORMING APPARATUS PROVIDED WITH THE BELT UNIT

(71) Applicant: BROTHER KOGYO KABUSHIKI KAISHA, Nagoya (JP)

(72) Inventors: Wataru Yamaguchi, Nisshin (JP); Kazuya Kamikawa, Nagakute (JP); Yohei Hashimoto, Nagakute (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/354,665

(22) Filed: Jun. 22, 2021

(65) Prior Publication Data

US 2022/0035275 A1 Feb. 3, 2022

(30) Foreign Application Priority Data

Jul. 31, 2020 (JP) ..... JP2020-130524

(51) Int. Cl.
*G03G 15/16* (2006.01)

(52) U.S. Cl.
CPC ..... *G03G 15/1615* (2013.01)

(58) Field of Classification Search
CPC ..... G03G 15/1615; G03G 21/18; G03G 21/1652; G03G 21/168; G03G 21/1867
USPC ..... 399/90, 111, 121, 302
See application file for complete search history.

(56) References Cited

U.S. PATENT DOCUMENTS

| | | | | |
|---|---|---|---|---|
| 9,348,268 | B2 * | 5/2016 | Hatano | G03G 15/1615 |
| 10,025,229 | B2 * | 7/2018 | Matsuura | G03G 15/1615 |
| 10,915,063 | B2 * | 2/2021 | Yoshida | G03G 21/1867 |
| 2011/0274457 | A1 | 3/2011 | Hayakawa | |
| 2011/0064467 | A1 | 11/2011 | Makino | |
| 2022/0004125 | A1 * | 1/2022 | Mitsumata et al. | G03G 15/1615 |

FOREIGN PATENT DOCUMENTS

| | | | |
|---|---|---|---|
| JP | 7-287453 | A1 | 10/1995 |
| JP | 2011-064897 | A1 | 3/2011 |
| JP | 2011-237566 | A1 | 11/2011 |

* cited by examiner

*Primary Examiner* — William J Royer
(74) *Attorney, Agent, or Firm* — Merchant & Gould P.C.

(57) ABSTRACT

A belt unit includes: a drive roller; a drive shaft having an axis defining an axial direction and rotatable together with the drive roller about the axis; a bearing rotatably supporting one end portion of the drive shaft; a driven shaft; a driven roller rotatable together with the driven shaft; an endless belt looped over the drive roller and the driven roller under tension; a first frame; and a second frame spaced away from the first frame in the axial direction. The first frame includes: a facing section supporting one end portion of the driven shaft; and a bearing holder holding the bearing. The second frame rotatably supports another end portions of the drive shaft and the driven shaft. The bearing holder is positioned closer to the second frame than the facing section is to the second frame in the axial direction.

19 Claims, 9 Drawing Sheets

BELT UNIT INCLUDING FIRST FRAME PROVIDED WITH BEARING HOLDER POSITIONED CLOSER TO SECOND FRAME, AND IMAGE-FORMING APPARATUS PROVIDED WITH THE BELT UNIT

CROSS REFERENCE TO RELATED APPLICATION

This application claims priority from Japanese Patent Application No. 2020-130524 filed Jul. 31, 2020. The entire content of the priority application is incorporated herein by reference.

TECHNICAL FIELD

The present disclosure relates to a belt unit and an image-forming apparatus including the belt unit.

BACKGROUND

Japanese Patent Application Publication No. 2011-064897 discloses a conventional belt unit mountable in an image-forming apparatus along with a process unit configured of a plurality of process cartridges.

An accommodation compartment is provided in the image-forming apparatus. The process unit is detachably accommodated in the accommodation compartment, and the belt unit is detachably accommodated in the accommodation compartment at a farther side (deeper) than the process unit. Inside the image-forming apparatus, a group of terminals are provided at a side surface of the accommodation compartment. The terminals are configured to contact the process unit accommodated in the accommodation compartment.

The belt unit includes a drive roller, a drive shaft integrally rotatable with the drive roller, a driven roller, a driven shaft integrally rotatable with the driven roller, and a transfer belt looped over the drive roller and the driven roller under tension. A bearing is disposed over one end portion of the drive shaft, and a drive gear is fixed to another end portion of the drive shaft.

The belt unit further includes a first belt frame and a second belt frame. The first belt frame supports the bearing to rotatably support the one end portion of the drive shaft and also rotatably supports one end portion of the driven shaft. The second belt frame rotatably supports the other end portion of the drive shaft and another end portion of the driven shaft. The first belt frame faces the side surface of the accommodation compartment in an attached state of the belt unit.

The bearing protrudes from a flat side surface of the first belt frame outward, i.e., in a direction away from the second belt frame, the flat side surface facing the side surface. The bearing also functions as a positioning member for fixing a position of the belt unit accommodated in the accommodation compartment.

SUMMARY

However, in the conventional belt unit described above, the bearing protrudes outward from the flat side surface of the first belt frame outward away from the second belt frame, and, hence, it is likely that the bearing may come into contact with the group of terminals for the process unit during attachment/detachment of the belt unit relative to the accommodation compartment. As such, the group of terminals may get damaged by hard contact or collision of the bearing against the group of terminals.

In view of the foregoing, it is an object of the disclosure to provide a belt unit and an image-forming apparatus capable of restraining damage to the group of terminals for the process unit by a bearing during attachment/detachment of the belt unit relative to the accommodation compartment.

In order to attain the above and other objects, according to one aspect, the disclosure provides a belt unit detachably mountable in an accommodation compartment of an image-forming apparatus along with a detachable process unit. The belt unit is positioned deeper than the process unit in a state where the belt unit and the process unit are accommodated in the accommodation compartment. The accommodation compartment has an inner side surface on which a group of terminals are provided. The group of terminals is configured to contact the process unit accommodated in the accommodation compartment. The belt unit includes a drive roller, a drive shaft, a bearing, a drive gear, a driven shaft, an endless belt, a first frame and a second frame. The drive shaft has an axis defining an axial direction and is rotatable together with the drive roller about the axis. The drive shaft has one end portion and another end portion in the axial direction. The bearing is disposed over the one end portion of the drive shaft to rotatably support the one end portion. The drive gear is fixed to the another end portion of the drive shaft. The driven shaft has one end portion and another end portion in the axial direction. The driven roller is rotatable together with the driven shaft. The endless belt is looped over the drive roller and the driven roller under tension. The first frame includes a facing section and a bearing holder. The facing section supports the one end portion of the driven shaft, and is configured to face the inner side surface upon accommodation of the belt unit in the accommodation compartment. The bearing holder holds the bearing and is connected to the facing section at a position between the drive shaft and the driven shaft. The second frame rotatably supports the another end portion of the drive shaft and the another end portion of the driven shaft. The second frame is spaced away from the first frame in the axial direction. The bearing holder is positioned closer to the second frame than the facing section is to the second frame in the axial direction.

According to another aspect, the disclosure also provides an image-forming apparatus including the above-described belt unit, a process unit, and an accommodation compartment configured to detachably accommodate therein the process unit and the belt unit. The belt unit is positioned deeper than the process unit in a state where the belt unit and the process unit are accommodated in the accommodation compartment. The accommodation compartment has an inner side surface on which a group of terminals are provided. The group of terminals is configured to contact the process unit accommodated in the accommodation compartment.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

1. First Embodiment

A belt unit 100 and an image-forming apparatus 1 according to a first embodiment of the disclosure will be described with reference to FIGS. 1 through 10.

Figure 1:
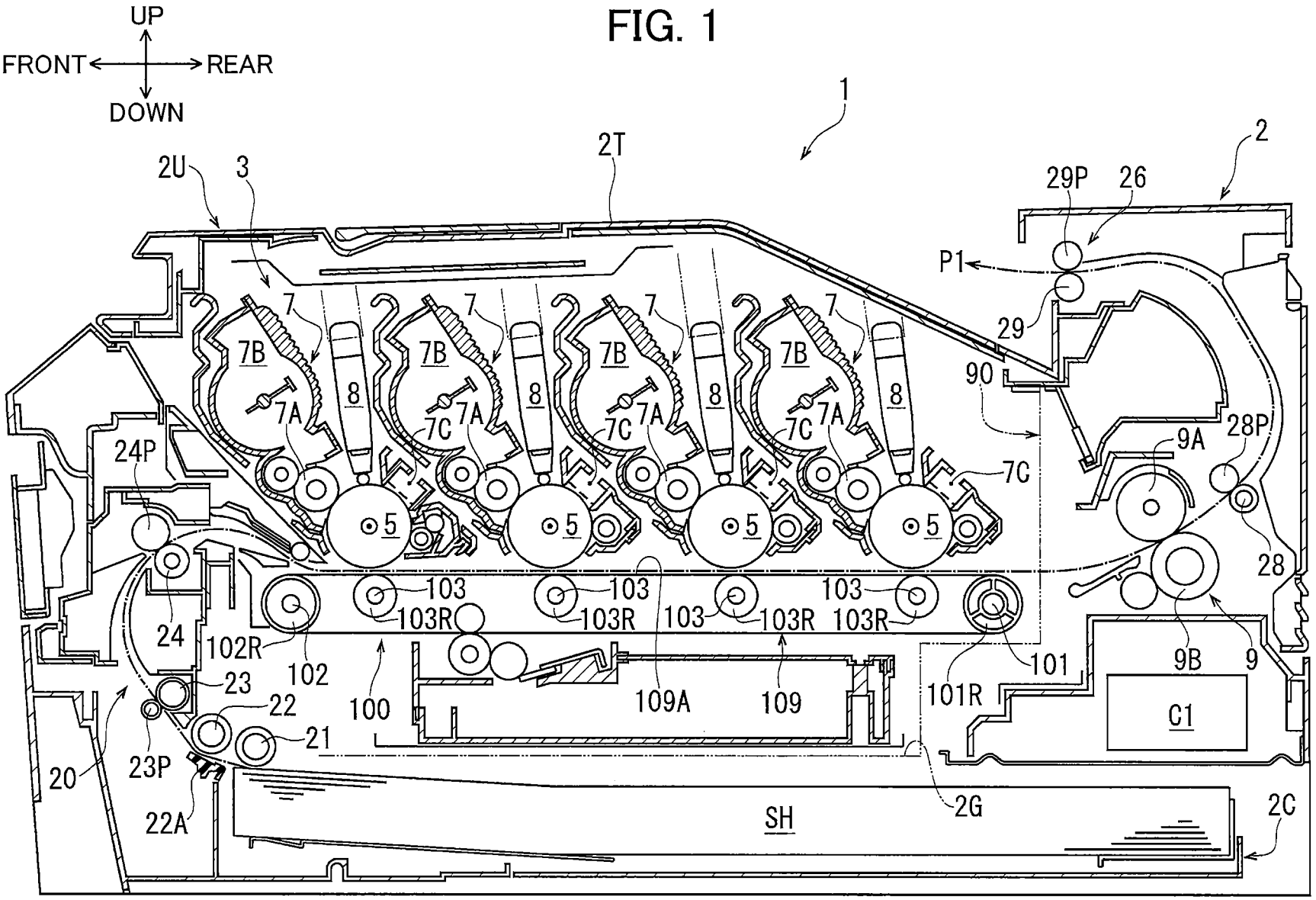
FIG. 1 is a schematic cross-sectional view of an image-forming apparatus and a belt unit according to a first embodiment of the disclosure.

The image-forming apparatus 1 illustrated in FIG. 1 is an electro-photographic type color printer for forming a multiple color image on a sheet SH. The belt unit 100 according to the first embodiment is provided in the image-forming apparatus 1.

<Overall Structure of the Image-Forming Apparatus 1>

The image-forming apparatus 1 includes an apparatus body 2, a supply unit 20, an image forming unit 3, and a discharge unit 26. The supply unit 20 is positioned at an internal front portion of the apparatus body 2. The discharge unit 26 is positioned at an internal upper-rear portion of the apparatus body 2. It should be noted that directions used in the following description and illustrated in FIGS. 2 through 11 in relation to the image-forming apparatus 1 will be consistent with those directions indicated in FIG. 1.

The apparatus body 2 includes a housing, and an inner frame (both not illustrated) provided in the housing. A sheet tray 2C is positioned at an internal lower portion of the apparatus body 2. The sheet tray 2C has a generally box shape having an upper open end. The sheet tray 2C is configured to accommodate therein a stack of a plurality of sheets SH. The sheet SH may be a plain sheet of paper, or an OHP sheet, for example.

Figure 2:
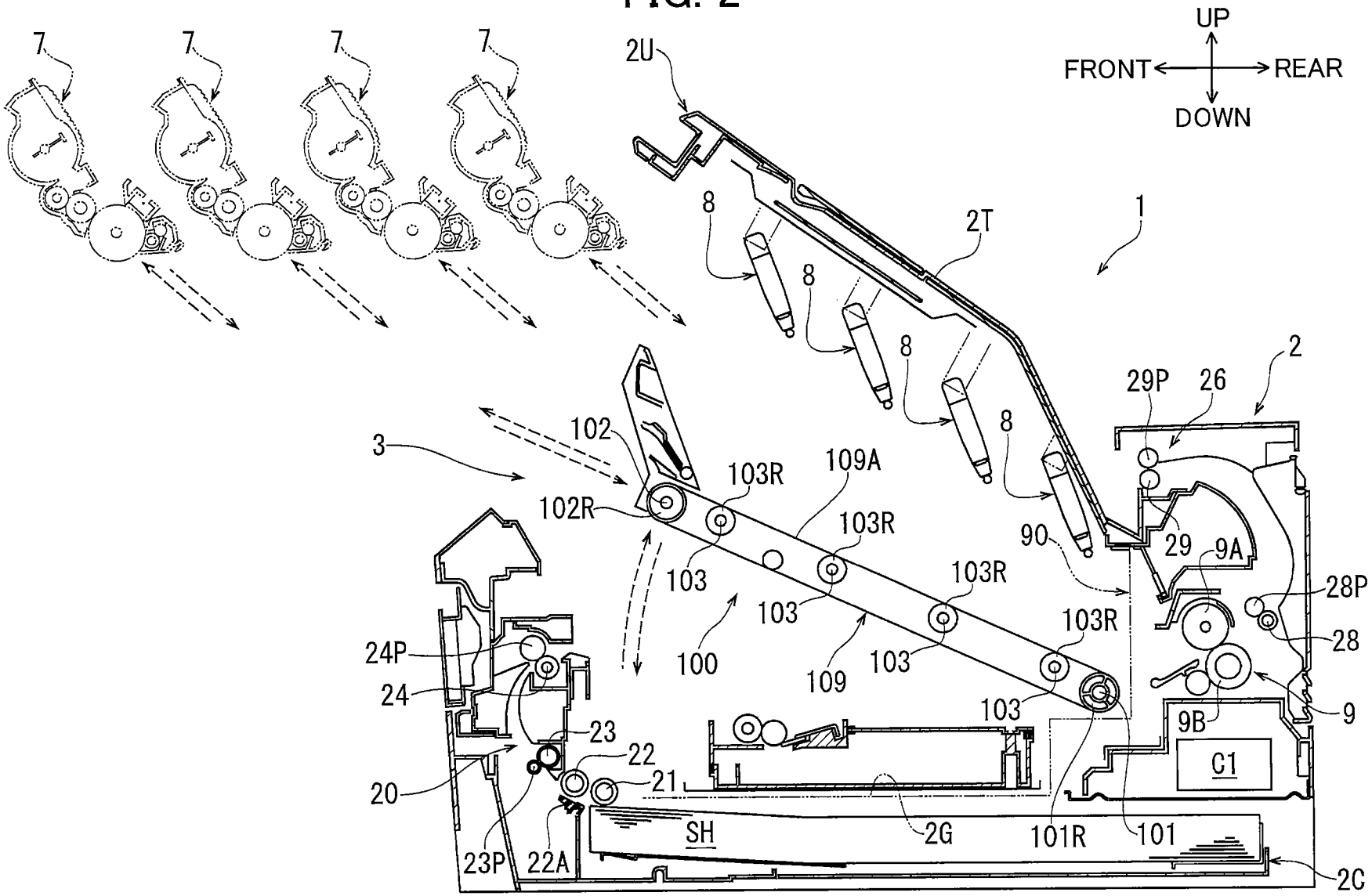
FIG. 2 is a schematic cross-sectional view of the belt unit and the image-forming apparatus for description of a process for attaching and detaching a process unit and the belt unit to and from an accommodation compartment inside the image-forming apparatus according to the first embodiment.

The apparatus body 2 has an upper wall 2U. The upper wall 2U is pivotally movable as illustrated in FIG. 2 such that a front end and a rear end of the upper wall 2U function as a free end and a base end thereof, respectively. The upper wall 2U has an upper surface serving as a discharge tray 2T. The discharge tray 2T is configured to receive the sheet SH on which an image is formed.

A conveyer passage P1 is provided in an interior of the apparatus body 2. The conveyer passage P1 has a generally S-shape in a side view such that: the conveyer passage P1 extends upward from a front end of the sheet tray 2C; and then is bent diagonally rearward into a U-shape; and then extends rearward in a substantially horizontal direction; and then is bent diagonally upward to form a U-shape to reach the discharge tray 2T at a position adjacent to a rear wall of the apparatus body 2.

A controller C1 is further provided inside the apparatus body 2. The controller C1 includes: an arithmetic part mainly including a CPU, a ROM and a RAM; and a hardware for controlling LEDs for exposure and a motor those not illustrated. The ROM stores therein programs for enabling the CPU to control various operations to be performed in the image-forming apparatus 1 and to implement prescribed identification processing. The RAM is used as a storage area for temporarily storing data and signals required for the CPU to execute the programs, or as a work area for data processing. The controller C1 is thus configured to control overall operations performed in the image-forming apparatus 1 such as operations performed in the supply unit 20, the image forming unit 3, and the discharge unit 26.

The supply unit 20 includes a feed roller 21, a separation roller 22, and a separation pad 22A for picking up one sheet SH at a time from the stack of the sheets SH accommodated in the sheet tray 2C, and for conveying each sheet SH to the conveyer passage P1. The supply unit 20 also includes, at the front U-turn section of the conveyer passage P1, a pair of conveyer rollers 23, 23P and a pair of registration rollers 24, 24P to convey the sheet SH to the image forming unit 3.

The image forming unit 3 is positioned inside the apparatus body 2 at a position above the sheet tray 2C. The sheet SH conveyed by the supply unit 20 toward the image forming unit 3 is configured to move past the image forming unit 3 while the sheet SH is conveyed along the generally horizontally extending section of the conveyer passage P1.

The image forming unit 3 of the present embodiment is of a direct transfer type color electro-photographic system. The image forming unit 3 includes four process cartridges 7, four LED heads 8 for exposure, the belt unit 100, and a fixing device 9. The process cartridges 7 and four LED heads 8 are positioned above the horizontally extending section of the conveyer passage P1. The belt unit 100 is positioned below the horizontally extending section of the conveyer passage P1. The fixing device 9 is positioned below the rear U-turn section of the conveyer passage P1.

Four pairs of the process cartridge 7 and the LED head 8 correspond to toners of four colors of black, yellow, magenta, and cyan, respectively, and are arrayed with one another in a frontward/rearward direction along the horizontally extending section of the conveyer passage P1.

Each process cartridge 7 includes a photosensitive body 5. The photosensitive body 5 is positioned at a lower end portion of a frame of the process cartridge 7. The photosensitive body 5 is a hollow cylindrical member rotatable about its axis. The photosensitive body 5 has an outer peripheral surface formed with a photosensitive layer with a positively-charged property.

The axis of the photosensitive body 5 extends in a direction perpendicular to the frontward/rearward direction and an upward/downward direction. Hereinafter, the extending direction of the axis of the photosensitive body 5 ("axial direction" indicated in FIGS. 3 through 11) will be based on the directions illustrated in FIG. 1. Specifically, a near side and a far side in the drawing sheet of FIG. 1 respectively correspond to one side and another side with respect to the axial direction of the photosensitive body 5 illustrated in FIGS. 3 through 11. For simplifying the description, the direction in which the axis of the photosensitive body 5 extends will be referred to "axial direction" simply, hereinafter.

Each process cartridge 7 further includes a developing roller 7A, a toner chamber 7B, and a charger 7C those positioned inside the process cartridge 7. The developing roller 7A is in contact with the corresponding photosensitive body 5.

Each LED head 8 is supported by the upper wall 2U of the apparatus body 2. Hence, each LED head 8 is movable (pivotable) in association with the pivotal movement of the upper wall 2U. Each LED head 8 is positioned directly above the corresponding photosensitive body 5. Each LED head 8 includes: a generally plate-like member extending in the upward/downward direction and the axial direction of the photosensitive body 5; and a plurality of LEDs arrayed in line in the axial direction on a lower surface of the plate-like member. Each LED head 8 is configured to irradiate a line-form light with a controlled exposure pattern on a basis of image data onto the surface of the corresponding photosensitive body 5. Hence, each LED head 8 forms a latent image on the surface of the corresponding photosensitive body 5 to allow toner to be carried thereon.

The belt unit 100 includes a drive shaft 101, a drive roller 101R, a driven shaft 102, a driven roller 102R, an endless belt 109, and four transfer rollers 103R.

The drive shaft 101 is positioned at an internal rear portion of the apparatus body 2 and extends in the axial direction of the photosensitive body 5. The drive shaft 101 is rotatable together with the drive roller 101R. The driven shaft 102 is positioned at an internal front portion of the apparatus body 2 and extends in the axial direction of the photosensitive body 5. The driven shaft 102 is rotatable together with the driven roller 102R. The endless belt 109 is looped over the drive roller 101R and the driven roller 102R under tension. The endless belt 109 is thus stretched under tension in the frontward/rearward direction in the present embodiment.

The endless belt 109 has an upper surface spanning between the drive roller 101R and the driven roller 102R. The upper surface constitutes the horizontally extending section of the conveyer passage P1, and functions as a conveying surface 109A. The conveying surface 109A thus faces upward and extends flat in the frontward/rearward direction to face each of the photosensitive bodies 5 from below.

The transfer rollers 103R are positioned in an internal space of the loop of the endless belt 109, and are arrayed with one another in the frontward/rearward direction between the drive roller 101R and the driven roller 102R. Each transfer roller 103R contacts the endless belt 109 to nip the endless belt 109 between the transfer roller 103R and the corresponding photosensitive body 5. The conveying surface 109A is applied with a negative voltage through the transfer rollers 103R. A reference numeral 103 designates a shaft of the transfer roller 103R.

The fixing device 9 is positioned rearward of the array of the process cartridges 7. The fixing device 9 includes a heat roller 9A and a pressure roller 9B. The fixing device 9 is configured to heat and apply pressure to the sheet SH, which has passed below the respective process cartridges 7, by nipping the sheet SH between the heat roller 9A and the pressure roller 9B.

The discharge unit 26 includes a first pair of discharge rollers 28, 28P and a second pair of discharge rollers 29, 29P those positioned inside the apparatus body 2. The first pair of discharge rollers 28, 28P is positioned at an intermediate portion of the rear U-turn section of the conveyer passage P1. The second pair of discharge rollers 29, 29P is positioned at an upper end of the rear U-turn section of the conveyer passage P1, i.e., at a most downstream end of the conveyer passage P1.

In the discharge unit 26, the sheet SH having moved past the fixing device 9 is nipped between the first pair of discharge rollers 28, 28P to convey the sheet SH toward the second pair of discharge rollers 29, 29P, and the sheet SH is discharged onto the discharge tray 2T by the second pair of discharge rollers 29, 29P.

In the image forming unit 3 configured as above, image formation on the sheet SH is performed in the following manner while the sheet SH is conveyed along the conveyer passage P1.

The surface of each photosensitive body 5 is exposed to the line-form light irradiated from the associated LED head 8 in accordance with rotations of each photosensitive body 5, after the surface of the photosensitive body 5 is uniformly charged with a positive polarity by the associated charger 7C. Hence, an electrostatic latent image corresponding to an output image to be formed on the sheet SH is formed on the surface of each photosensitive body 5.

The developing roller 7A of each process cartridge 7 then supplies toner of associated color from the toner chamber 7B to the electrostatic latent image formed on the surface of the corresponding photosensitive body 5 to form a toner image on the surface of the photosensitive body 5. The toner image is then transferred onto the sheet SH conveyed along the horizontally extending section of the conveyer passage P1 while the photosensitive body 5 rotationally contacts the conveyed sheet SH with a negative voltage applied thereto through the conveying surface 109A of the endless belt 109.

Thereafter, in the fixing device 9, the sheet SH is heated under pressure to thermally fix the toner image to the sheet SH. The sheet SH passing through the fixing device 9 is then discharged onto the discharge tray 2T by the first pair of discharge rollers 28, 28P and the second pair of discharge rollers 29, 29P.

<Accommodation Compartment 90>

An accommodation compartment 90 is defined inside the image-forming apparatus 1. Specifically, the accommodation compartment 90 is in the internal space of the apparatus body 2, and is positioned frontward of the fixing device 9 and upward of the sheet tray 2C, and is covered by the upper wall 2U from above. The accommodation compartment 90 is configured to detachably accommodate therein the respective process cartridges 7. The accommodation compartment 90 is also configured to detachably accommodate the belt unit 100 at a position deeper than each of the process cartridges 7, i.e., at the position below the process cartridges 7.

As illustrated in FIG. 2, an upper side of the accommodation compartment 90 is opened by pivotally moving the upper wall 2U diagonally upward and rearward. At this time, each of the LED heads 8 is moved together with the upper wall 2U. Further, each LED head 8 is pivotally moved so that its lower end (free end) is moved rearward during upward movement of the upper wall 2U. Hence, each LED head 8 is moved upward away from the accommodation compartment 90.

In this state where the accommodation compartment 90 is open upward, each process cartridge 7 can be detached from the accommodation compartment 90 by pulling each process cartridge 7 diagonally upward and frontward. Further, each process cartridge 7 can be attached to the accommodation compartment 90 by performing the above-described detaching operation in reverse.

After all the process cartridges 7 are detached from the accommodation compartment 90, the belt unit 100 can be detached from the accommodation compartment 90 by: lifting a front end portion of the belt unit 100 to bring the belt unit 100 into an inclined posture inclined downward toward the rearward; and then by pulling the belt unit 100 diagonally upward and frontward. The belt unit 100 can be attached to the accommodation compartment 90 by performing the above-described detaching operation in reverse.

Figure 3:
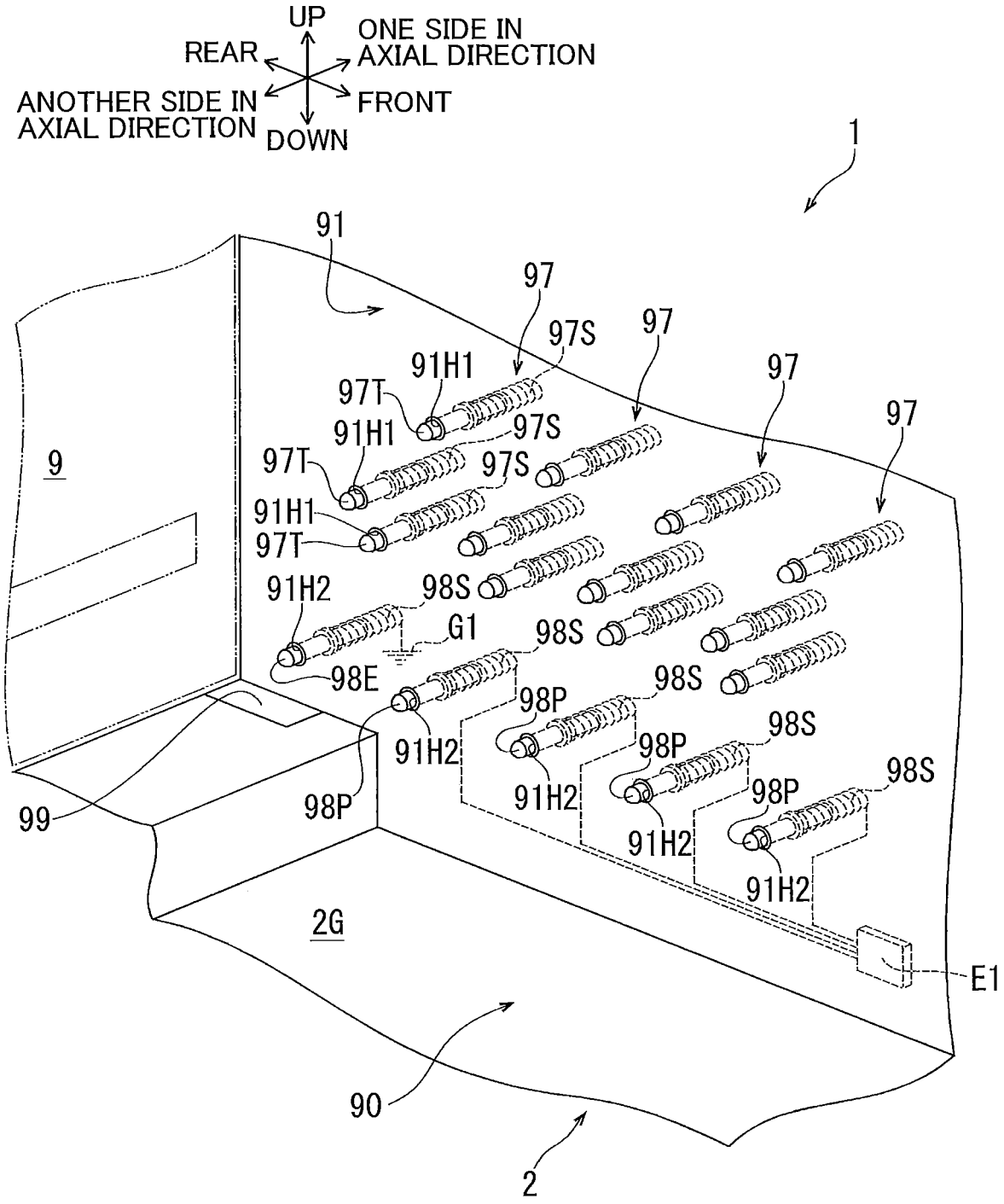
FIG. 3 is a partial perspective view illustrating a side surface of the accommodation compartment where a group of terminals for the process unit, power feed electrodes for the belt unit, and a ground electrode for the belt unit are provided.

As illustrated in FIG. 3, the accommodation compartment 90 is defined by a side surface 91. That is, the side surface 91 defines one end of the accommodation compartment 90 in the axial direction of the photosensitive body 5. Specifically, the side surface 91 is a side surface of an internal frame member constituting the inner frame of the apparatus body 2, the internal frame member being made from resin and assembled to a side frame (not illustrated) of the housing of the apparatus body 2. The side surface 91 is an uneven surface for supporting each process cartridge 7 and the belt unit 100. In FIG. 3, the side surface 91 is illustrated in a simplified manner to facilitate understanding.

Although not illustrated, another internal frame member made from resin is assembled to the other side frame (not illustrated) of the housing of the apparatus body 2 to provide another side surface defining another end of the accommodation compartment 90 in the axial direction. The other side surface is also an uneven surface for supporting each process cartridge 7 and the belt unit 100.

At the side surface 91 of the accommodation compartment 90 provided are four sets of: a group of terminals 97 for the respective process cartridges 7; and a grounding electrode 98E and four power feed electrodes 98P those for the belt unit 100.

Each group of terminals 97 is positioned to face one end of the corresponding process cartridge 7 in the axial direction in a state where the process cartridge 7 is accommodated in the accommodation compartment 90. Although not illustrated, the one end of the process cartridge 7 in the axial direction is provided with three terminals electrically connected to the photosensitive body 5, the developing roller 7A, and the charger 7C.

Each group of terminals 97 includes three terminals 97T and three urging springs 97S. Each terminal 97T is generally solid cylindrical whose tip end has a semispherical shape. Each terminal 97T extends through a corresponding terminal hole 91H1 formed in the side surface 91 so as to be movable relative to the accommodation compartment 90 using the urging force of the corresponding urging spring 97S. That is, the terminals 97T can protrude into the accommodation compartment 90 by the urging forces of the respective urging springs 97S.

Each of the terminals 97T in each group of terminals 97 is configured to contact each of the terminals provided at the one end of the corresponding process cartridge 7 in the axial direction to provide electrical connection to the photosensitive body 5, the developing roller 7A, and the charger 7C of the process cartridge 7 in a state where the process cartridge 7 is accommodated in the accommodation compartment 90.

The grounding electrode 98E and the four power feed electrodes 98P are positioned below the four groups of terminals 97, and are arranged in line in the frontward/rearward direction. The grounding electrode 98E is positioned rearward of the four power feed electrodes 98P.

Each of the grounding electrode 98E and the power feed electrodes 98P has a configuration the same as that of each terminal 97T, and is provided with an urging spring 98S. Each of the grounding electrode 98E and the four power feed electrodes 98P extends through a corresponding terminal hole 91H2 formed in the side surface 91 so as to be movable relative to the accommodation compartment 90 using the urging force of the corresponding urging spring 98S. That is, each of the grounding electrode 98E and the four power feed electrodes 98P can protrude into the accommodation compartment 90 by the urging force of the corresponding urging spring 98S.

The grounding electrode 98E is electrically connected to a grounding G1 positioned inside the apparatus body 2. Each of the power feed electrodes 98P is electrically connected through a wiring to an electronic component E1 provided near the side surface 91 in the apparatus body 2.

Upon accommodation of the belt unit 100 in the accommodation compartment 90, the grounding electrode 98E is in contact with a bearing 150 (see FIGS. 4 through 10) of the belt unit 100; and each power feed electrode 98P is in contact with a charge terminal 103T (see FIGS. 4, 7, and 9) of the belt unit 100. Details of the bearing 150 and the charge terminals 103T will be described later.

The accommodation compartment 90 includes a positioning portion 99 which is a flat surface facing upward. The positioning portion 99 is formed in a plate member 2G defining the bottom of the accommodation compartment 90. Referring to FIGS. 1 and 3, the plate member 2G is provided inside the apparatus body 2 at a position above the sheet tray 2C. The positioning portion 99 is formed in the plate member 2G at a rear corner portion thereof, the rear corner portion being at one end portion of the plate member 2G in the axial direction.

Upon accommodation of the belt unit 100 in the accommodation compartment 90, the positioning portion 99 is configured to abut on a counterpart positioning portion 119 (see FIGS. 4, 6 and 7) of the belt unit 100 from below. This abutment of the counterpart positioning portion 119 on the positioning portion 99 can serve to fix a vertical position of a rear corner portion of the belt unit 100, the rear corner portion being at one end portion of the belt unit 100 in the axial direction. Details of the counterpart positioning portion 119 will be described later.

Incidentally, although not illustrated, the accommodation compartment 90 further includes: positioning portions for fixing vertical positions of remaining three corner portions of the belt unit 100; and additional positioning portions for fixing a frontward/rearward position of the belt unit 100.

<Details of the Belt Unit 100>

Figure 4:
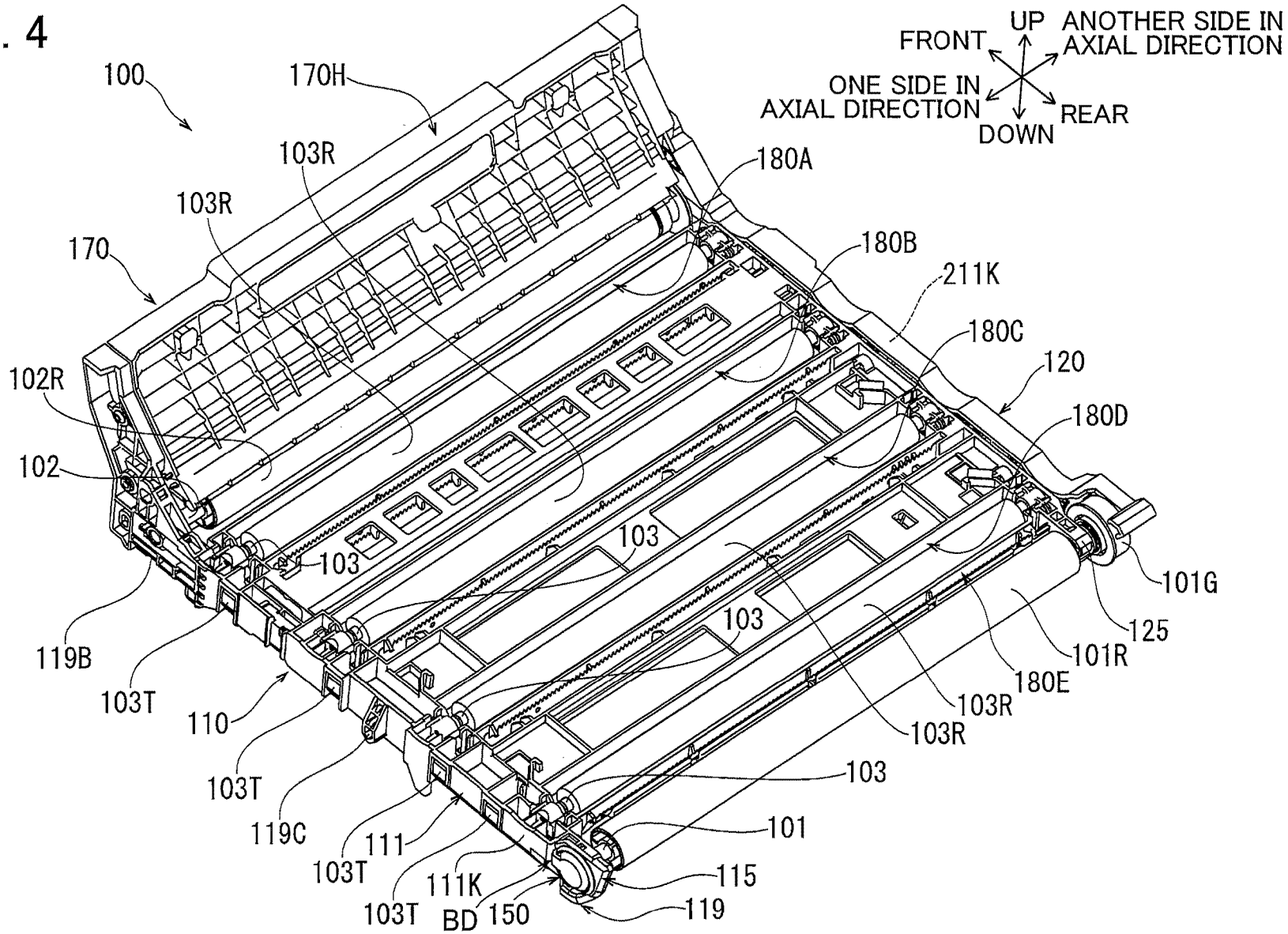
FIG. 4 is a perspective view of the belt unit according to the first embodiment, wherein delineation of an endless belt is omitted.
Figure 5:
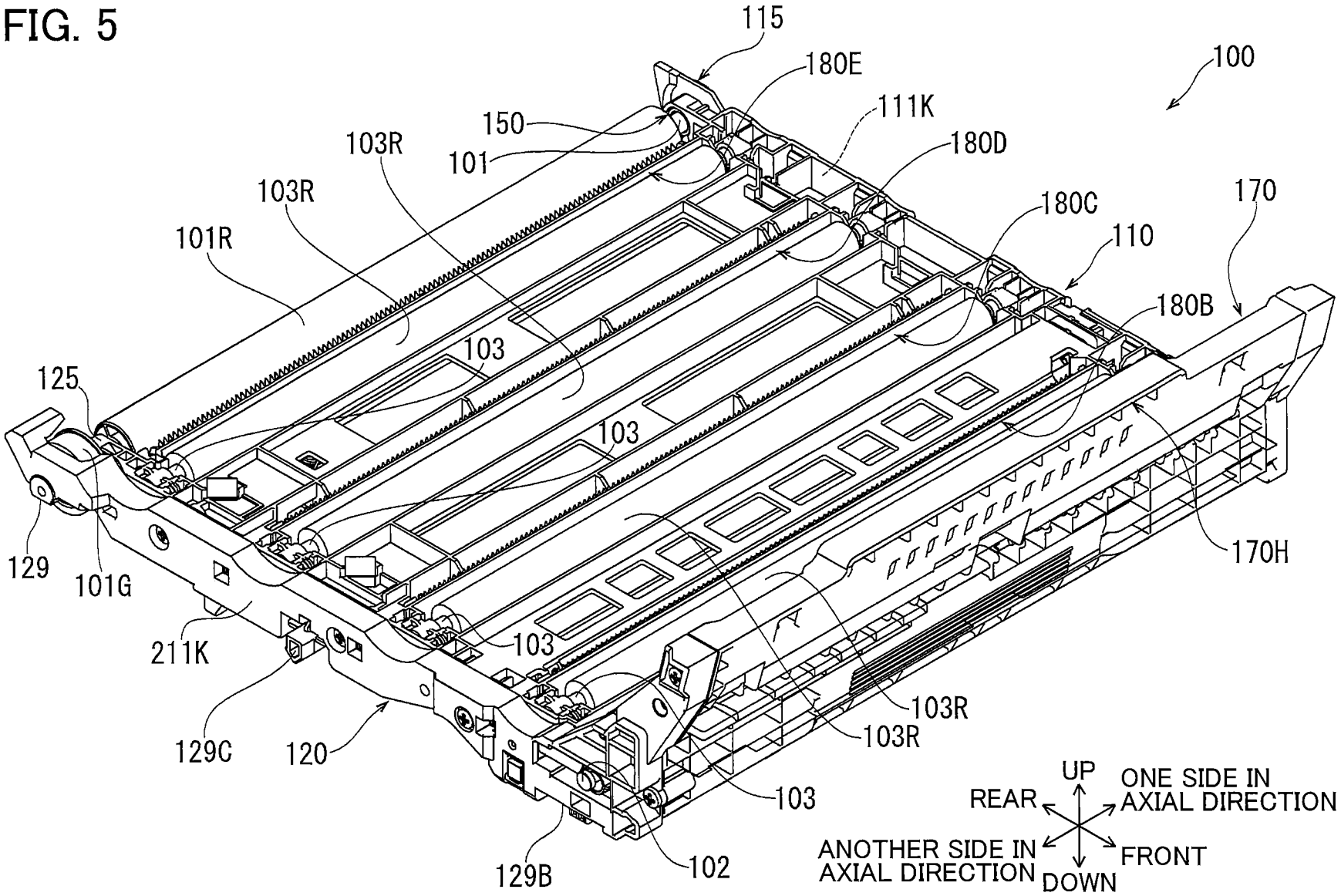
FIG. 5 is another perspective view of the belt unit according to the first embodiment, wherein delineation of the endless belt is omitted.

As illustrated in FIGS. 4 and 5, the belt unit 100 further includes a first frame 110, a second frame 120, a front connection frame 170, and five intermediate connection frames 180A, 180B, 180C, 180D and 180E, in addition to the above-described drive shaft 101, the drive roller 101R, the driven shaft 102, the driven roller 102R, the endless belt 109, and the four transfer rollers 103R.

The first frame 110 is positioned outward of the drive roller 101R, the driven roller 102R, the four transfer rollers 103R, and the endless belt 109 (not illustrated in FIGS. 4 and 5) in the axial direction. In other words, the first frame 110 constitutes the one end portion of the belt unit 100 in the axial direction. The first frame 110 extends throughout a length (from a front end to a rear end) of the belt unit 100 in the frontward/rearward direction which is coincident with the direction in which tensile force is applied to the endless belt 109.

The first frame 110 faces the side surface 91 in the accommodated state of the belt unit 100 in the accommodation compartment 90, as well as during the attachment/detachment of the belt unit 100 relative to the accommodation compartment 90.

The second frame 120 is positioned outward of the drive roller 101R, the driven roller 102R, the four transfer rollers 103R, and the endless belt 109 (not illustrated in FIGS. 4 and 5) in the axial direction. That is, the second frame 120 constitutes the other end portion of the belt unit 100 in the axial direction. The second frame 120 extends throughout the length (from the front end to the rear end) of the belt unit 100 in the frontward/rearward direction.

The second frame 120 faces the other side surface (not illustrated) of the accommodation compartment 90 in the accommodated state of the belt unit 100 in the accommodation compartment 90, as well as during the attachment and detachment of the belt unit 100 to and from the accommodation compartment 90.

The front connection frame 170 extends in the axial direction to connect a front end of the first frame 110 and a front end of the second frame 120 to each other. The front connection frame 170 thus constitutes the front end portion of the belt unit 100. The front connection frame 170 has an extension portion protruding diagonally upward and frontward from a position above the driven roller 102R. A hand grip portion 170H is provided on an upper end portion of the extension portion. The hand grip portion 170H is configured to be gripped by a user for attaching and detaching the belt unit 100 to and from the accommodation compartment 90.

The intermediate connection frames 180A, 180B, 180C, 180D, and 180E are positioned rearward of the front connection frame 170, and are arrayed with one another in the frontward/rearward direction. Each of the intermediate connection frames 180A, 180B, 180C, 180D and 180E extends in the axial direction to span between the first frame 110 and second frame 120.

In the present embodiment, a frame of the belt unit 100 is constituted by assembling together a first resin member, a second resin member, and a third resin member. The first resin member includes the first frame 110, the intermediate connection frames 180A, 180B, 180C, 180D, 180E, and a part of the second frame 120 those being integrally formed. The second resin member is a remaining part of the second frame 120. The third resin member is the front connection frame 170.

Incidentally, the frame of the belt unit 100 need not be configured of the above-described three resin members. For example, the first frame 110 and the second frame 120 may be discrete resin members, and the first and second frames 110 and 120 may be connected to each other by the plurality of connection frames 170, 180A-180E.

As illustrated in FIGS. 4 through 9, the first frame 110 has a rear end portion provided with a bearing holder 115. The drive shaft 101 has one end portion in the axial direction over which a bearing 150 is disposed. The bearing holder 115 holds the bearing 150 for rotatably supporting the one end portion of the drive shaft 101.

As illustrated in FIGS. 4 and 5, the second frame 120 has a rear end portion provided with a drive-shaft support portion 125. The drive shaft 101 has another end portion in the axial direction to which a drive gear 101G is fixed. The drive-shaft support portion 125 is positioned adjacent to an inner surface of the drive gear 101G, the inner face facing the first frame 110 in the axial direction. The drive-shaft support portion 125 rotatably supports the other end portion of the drive shaft 101 in the axial direction. The drive gear 101G is configured to receive a driving force from a drive source (not illustrated) to drive the image forming unit 3 for image formation, for example.

As illustrated in FIG. 4, the first frame 110 has a front end portion rotatably supporting one end portion of the driven shaft 102 in the axial direction. The second frame 110 has a front end portion rotatably supporting another end portion of the driven shaft 102 in the axial direction.

The intermediate connection frame 180A is positioned rearward of the driven roller 102R. The intermediate connection frame 180E is positioned frontward of the drive roller 101R.

The transfer rollers 103R are respectively positioned: between the intermediate connection frames 180A and 180B; between the intermediate connection frames 180B and 180C; between the intermediate connection frames 180C and 180D; and between the intermediate connection frames 180D and 180E.

The shaft 103 of each transfer roller 103R has one end portion and another end portion in the axial direction which are rotatably supported by the first frame 110 and the second frame 120, respectively.

The four charge terminals 103T are provided on a side surface of the first frame 110, the side surface facing outward in the axial direction. Each charge terminal 103T is electrically connected to the rotation shaft 103 and the corresponding transfer roller 103R. Further, as described above, each charge terminal 103T is in contact with the corresponding power feed electrode 98P (FIG. 3) upon accommodation of the belt unit 100 in the accommodation compartment 90.

As illustrated in FIG. 4, the first frame 110 includes the counterpart positioning portion 119, a counterpart positioning portion 119B, and a counterpart positioning portion 119C. The counterpart positioning portion 119 is provided on the bearing holder 115 positioned at the rear end portion of the first frame 110. The counterpart positioning portion 119B is positioned at the front end portion of the first frame 110. The counterpart positioning portion 119C is positioned at an intermediate portion between the front and rear end portions of the first frame 110.

As illustrated in FIG. 5, the second frame 120 includes a counterpart positioning portion 129, a counterpart positioning portion 129B, and a counterpart positioning portion 129C. The counterpart positioning portion 129 is positioned at the rear end portion of the second frame 120, and the counterpart positioning portion 129B is positioned at the front end portion of the second frame 120. The counterpart positioning portion 129C is positioned at an intermediate portion between the front and rear end portions of the second frame 120.

Figure 7:
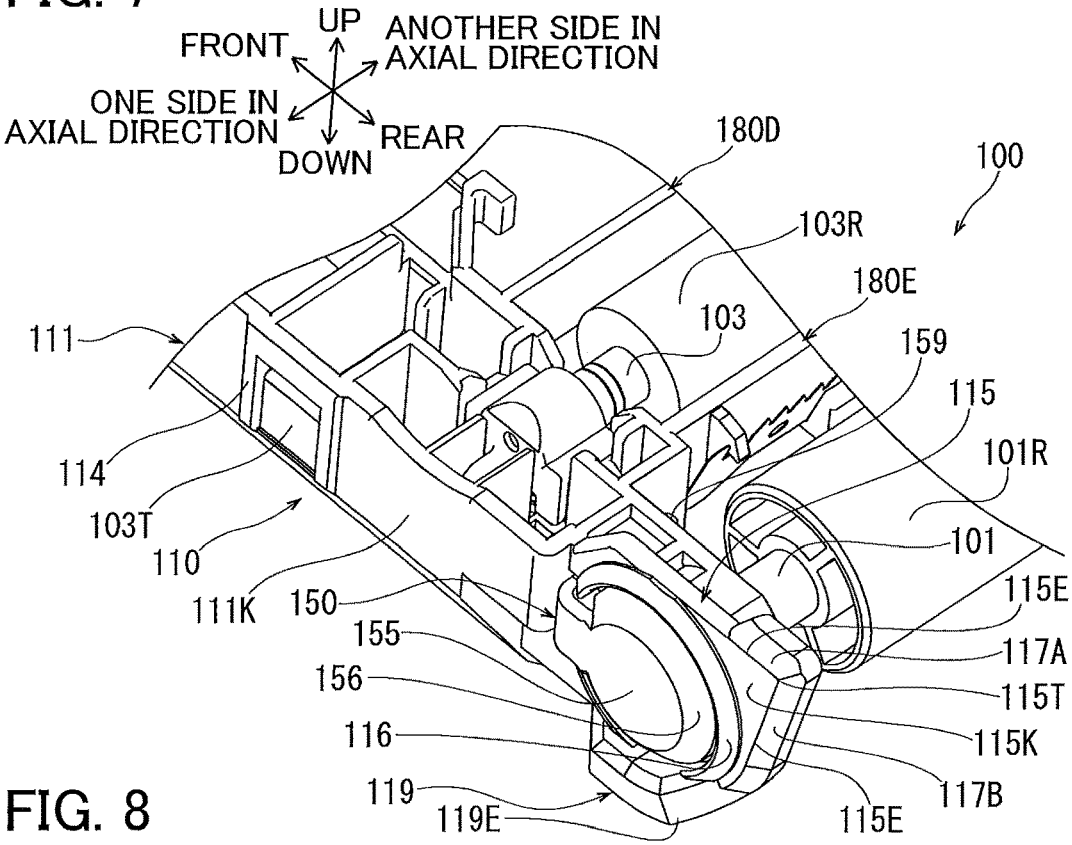
FIG. 7 is a partially enlarged perspective view of the belt unit according to the first embodiment without delineation of the endless belt, and particularly illustrating the drive roller, the bearing holding portion, and the components adjacent to the side surface.
Figure 9:
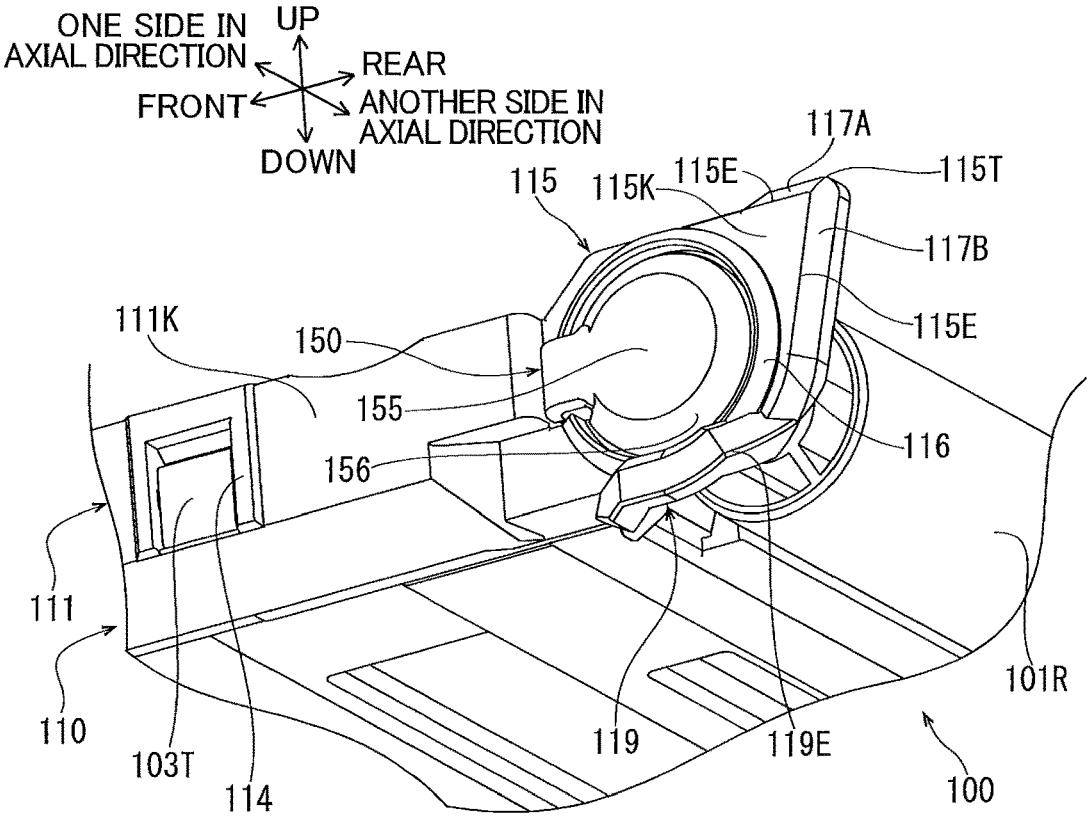
FIG. 9 is still another partially enlarged perspective view of the belt unit t according to the first embodiment without delineation of the endless belt, and particularly illustrating the drive roller, the bearing holding portion, and the components adjacent to the side surface.

As illustrated in FIGS. 7 and 9, the counterpart positioning portion 119 protrudes from a lower peripheral end portion of the bearing holder 115 outward in the axial direction, i.e., in a direction away from the second frame 120. The counterpart positioning portion 119 is plate shaped having a chamfered free end 119E.

In the accommodated state of the belt unit 100 in the accommodation compartment 90, the counterpart positioning portion 119 is seated on the positioning portion 99 (FIG. 3). Further, the counterpart positioning portions 119B, 129, 129B are also seated on the non-illustrated positioning portions of the accommodation compartment 90. In this way, the vertical position of the belt unit 100 can be fixed in the accommodation compartment 90. Further, each of the counterpart positioning portions 119C, 129C is nipped by a pair of positioning portions (not illustrated) in the frontward/rearward direction. Hence, the frontward/rearward position of the belt unit 100 can also be fixed in the accommodation compartment 90.

As illustrated in FIGS. 4 through 9, the first frame 110 includes a facing section 111 and the bearing holder 115. The facing section 111 faces the side surface 91 of the accommodation compartment 90 with a close distance therebetween in the accommodated state of the belt unit 100 in the accommodation compartment 90. The facing section 111 and the bearing holder 115 define a boundary BD therebetween that is positioned between the drive shaft 101 and the driven shaft 102 in the frontward/rearward direction. The facing section 111 extends to the front end of the first frame 110, as illustrated in FIG. 4.

Figure 6:
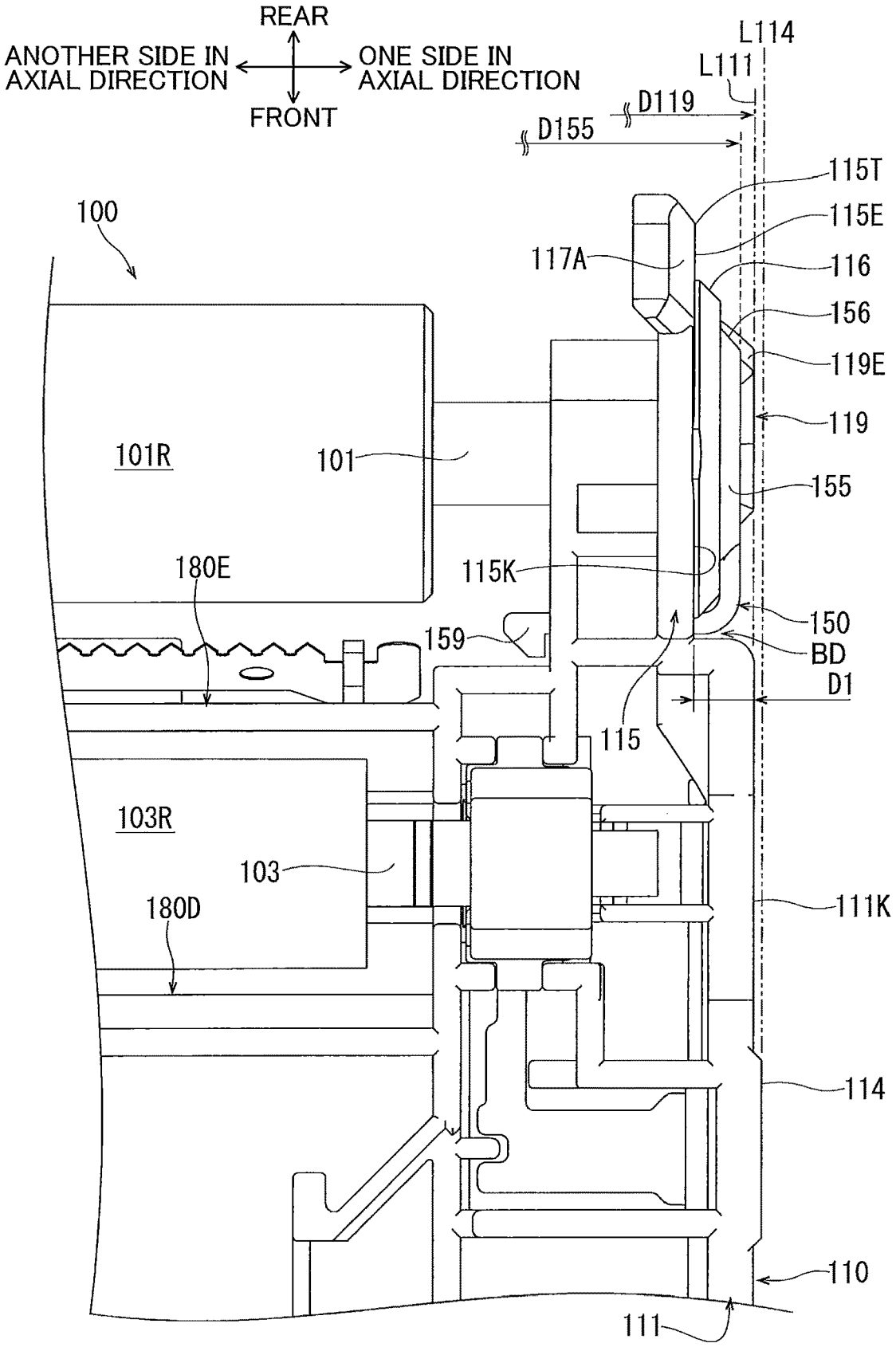
FIG. 6 is a partially enlarged plan view of the belt unit according to the first embodiment without delineation of the endless belt, and particularly illustrating a drive roller, a bearing holding portion, and components adjacent to the side surface.

Specifically, as illustrated in FIG. 6, the boundary BD between the bearing holder 115 and the facing section 111 is positioned, in the frontward/rearward direction, in a region between a frontmost end of an outer peripheral surface of the drive roller 101R and a rearmost end of an outer peripheral surface of the rearmost transfer roller 103R.

As illustrated in FIGS. 6, 7 and 9, with regard to the axial direction, the bearing holder 115 is positioned closer to the second frame 120 than the facing section 111 is to the second frame 120. Hence, a stepped portion is formed at the boundary BD between the bearing holder 115 and the facing section 111. In the accommodated state of the belt unit 100 in the accommodation compartment 90, the facing section 111 is positioned closer to the side surface 91 than the bearing holder 115 is to the side surface 91 in the axial direction.

More specifically, the facing section 111 has an outer surface facing outward in the axial direction, i.e., in the direction away from the second frame 120. This outer surface has surface-irregular portions, and is mainly provided by a facing surface 111K. Further, four ribs 114 are provided at the facing surface 111K. Each rib 114 protrudes from the facing surface 111K outward in the axial direction, i.e., in the direction away from the second frame 120. Each rib 114 has an end surface positioned farthest from the second frame 120 among the outer surface of the facing section 111 in the axial direction. In the first frame 110, the rib 114 are farthest from the second frame 120 in the axial direction.

The four charge terminals 103T are provided on the facing surface 111K of the facing section 111. A front side, a rear side, and an upper side of each charge terminal 103T is surrounded by the corresponding one of the ribs 114. That is, each rib 114 has an inverted U shape.

The bearing holder 115 has a holding surface 115K facing outward (away from the second frame 120) in the axial direction. The holding surface 115K constitutes part of the stepped portion (the boundary BD) between the bearing holder 115 and the facing section 111. The holding surface 115K is positioned closer to the second frame 120 than the facing surface 111K is to the second frame 120 in the axial direction.

FIG. 6 indicates an extension line L111 extending rearward from the facing surface 111K, and an extension line L114 extending rearward from the end surface of the rib 114. Further, FIG. 6 also indicates a dimension D1 of the stepped portion, i.e., the distance in the axial direction between the facing surface 111K of the facing section 111 and the holding surface 115K of the bearing holder 115.

<Bearing 150>

Figure 10:
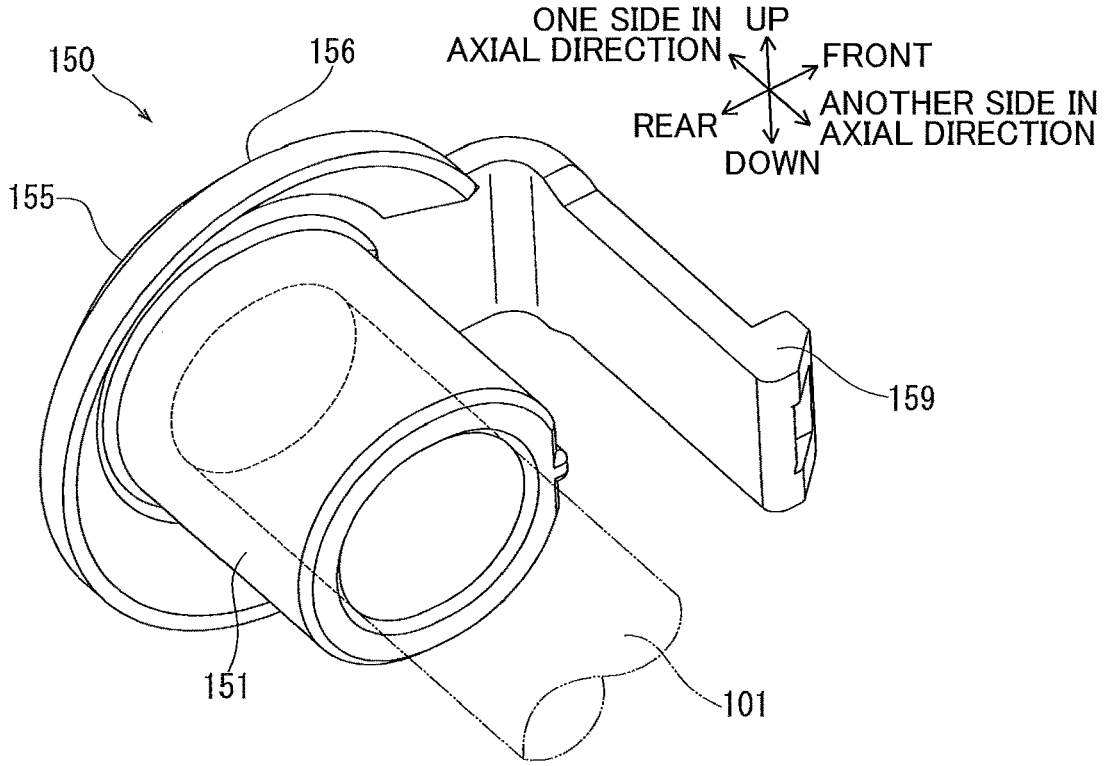
FIG. 10 is a perspective view of the bearing.

As illustrated in FIG. 10, the bearing 150 is an integrally molded product made from electrically conductive resin. The bearing 150 includes a body portion 151, a protruding portion 155, and an engagement protrusion 159.

The body portion 151 has a hollow cylindrical shape whose inner peripheral surface is coated with an electrically conductive grease. The body portion 151 has an inner diameter so sized that the one end portion of the drive shaft 101 can be inserted without any rattling.

The protruding portion 155 has a generally disc shape protruding radially outwardly from one end portion of the body portion 151 in the axial direction. That is, the protruding portion 155 extends perpendicularly to the axial direction. The protruding portion 155 closes an open end (the one end portion) of the body portion 151 to cover one end of the drive shaft 101 inserted in the body portion 151.

The protruding portion 155 has an outer peripheral surface on which a sloped surface 156 is formed. The sloped surface 156 is conically formed such that a diameter of the sloped surface 156 is increased as extending toward the second frame 120 from the first frame 110 in the axial direction. In other words, the sloped surface 156 is sloped to increase a distance from the axis of the drive shaft 101 toward the second frame 120.

The sloped surface 156 has a front notched portion from which the engagement protrusion 159 extends frontward. The engagement protrusion 159 extends, from the sloped surface 156, frontward and is then bent inward in the axial direction toward the second frame 120. The engagement protrusion 159 has a free end portion provided with a key-shaped pawl.

Figure 8:
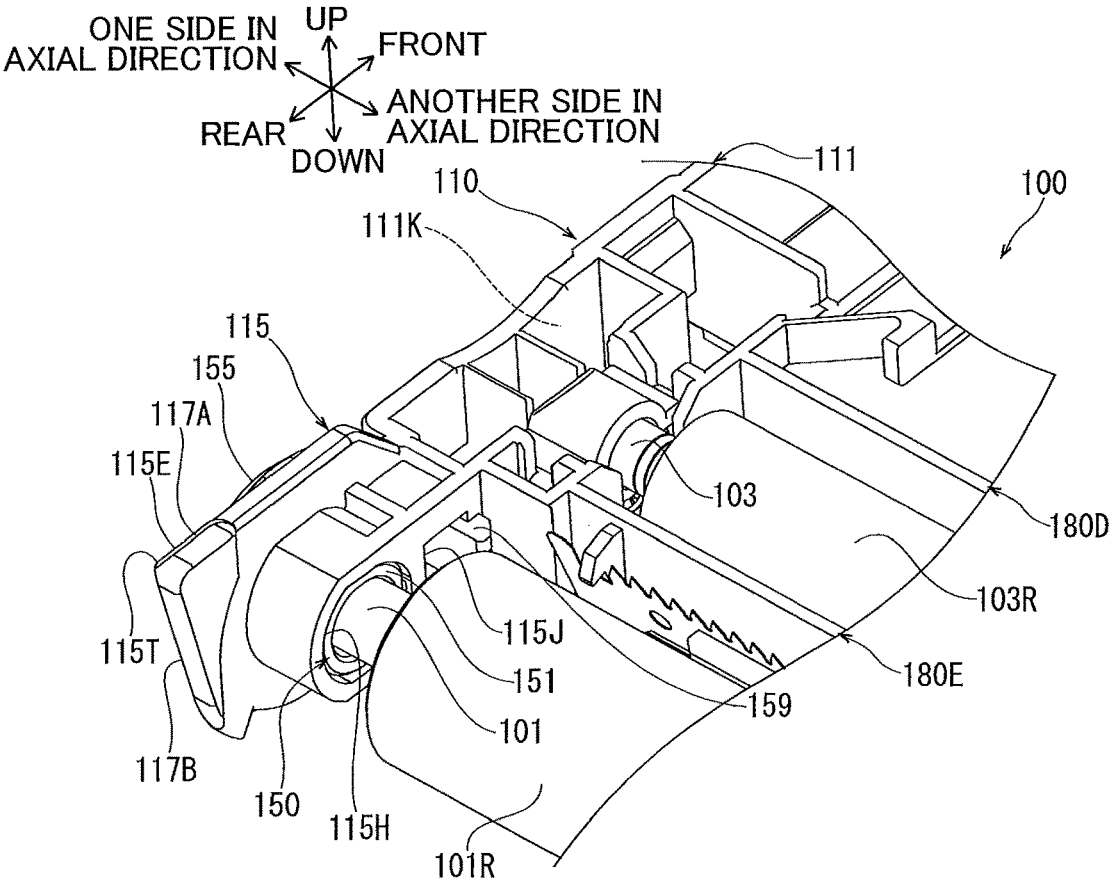
FIG. 8 is another partially enlarged perspective view of the belt unit according to the first embodiment without delineation of the endless belt, and particularly illustrating the drive roller, the bearing holding portion, and the components adjacent to the side surface.

As illustrated in FIG. 8, the bearing holder 115 is formed with a bearing retaining hole 115H and an engagement hole 115J. The body portion 151 of the bearing 150 is inserted in the bearing retaining hole 115H in the axial direction from inward thereof, and the engagement protrusion 159 of the bearing 150 is inserted through the engagement hole 115J so that the key-shaped pawl is engaged with a surface of the bearing holder 115, the surface surrounding an open end of the engagement hole 115J. Hence, the bearing 150 is held by the bearing holder 115 so that the bearing 150 does not make any rotation relative to the bearing holder 115.

As illustrated in FIGS. 7 and 9, the protruding portion 155 protrudes further outward (away from the second frame 120) in the axial direction than the holding surface 115K of the bearing holder 115. The protruding portion 155 thus covers the one end of the drive shaft 101 from radially outward thereof, i.e., at a position opposite the second frame 120 with respect to the first frame 110 in the axial direction. The sloped surface 156 is sloped to approach such that its diameter is increased toward the second frame 120 in the axial direction. The sloped surface 156 has an outer peripheral portion that is seated on the holding surface 115K of the bearing holder 115.

The protruding portion 155 of the bearing 150 is in contact with the grounding electrode 98E (FIG. 3) in the accommodated state of the belt unit 100 in the accommodation compartment 90.

As illustrated in FIG. 6, the end surface of the protruding portion 155 is distant from the second frame 120 by a distance D155 which is equal to or shorter than a distance by which the end face of the rib 114 is remote from the second frame 120. Preferably, the distance D155 between the end surface of the protruding portion 155 and the second frame 120 is shorter than the distance between the end face of the rib 114 and the second frame 120, and is also shorter than the distance between the facing surface 111K and the second frame 120. That is, the end surface of the protruding portion 155 does not exceed the extension line L111 in the axial direction, and is not positioned on the extension line L111 in the axial direction, either.

The counterpart positioning portion 119 has an end face positioned farthest from the second frame 120 in the axial direction and extending in the frontward/rearward direction. The end face of the counterpart positioning portion 119 is distant from the second frame 120 by a distance D119 which is equal to or shorter than the distance between the end face of the rib 114 and the second frame 120. Preferably, the distance D119 between the end face of the counterpart positioning portion 119 and the second frame 120 is shorter than the distance between the end face of the rib 114 and the second frame 120, and is substantially equal to the distance between the facing surface 111K and the second frame 120. That is, the end face of the counterpart positioning portion 119 does not exceed the extension line L111 in the axial direction, but is positioned on the extension line L111 in the axial direction.

Incidentally, in the present embodiment, the above-described distances D155, D119 are measured from a reference surface 211K of the second frame 120. Referring to FIG. 5, the reference surface 211K faces outward (away from the first frame 110) in the axial direction and constitutes a major portion of the outer side surface of the second frame 120 (on the other side in the axial direction).

<First Inclined Surface 116 and Second Inclined Surfaces 117A, 117B of the Bearing Holder 115>

As illustrated in FIGS. 6, 7 and 9, the bearing holder 115 has a first inclined surface 116 and second inclined surfaces 117A, 117B.

The first inclined surface 116 protrudes from the holding surface 115K outward (away from second frame 120) in the axial direction, and extends in a circumferential direction of the drive shaft 101 to surround the protruding portion 155 of the bearing 150. The first inclined surface 116 does not have a complete annular shape, but has a notched front end portion to as to avoid interference with the engagement protrusion 159 of the bearing 150. The first inclined surface 116 is inclined such that a diameter of the first inclined surface 116 is decreased as the first inclined surface 116 extends away from the second frame 120. In other words, the first inclined surface 116 is sloped to increase a distance from the axis of the drive shaft 101 toward the second frame 120.

As illustrated in FIG. 7, the bearing holder 115 has a generally rectangular outer peripheral edge 115E positioned away from the facing section 111 in the axial direction. Specifically, the outer peripheral edge 115E has a rear part extending diagonally upward and rearward, and an upper horizontally extending part extending frontward from an upper end of the rear part. The rear part and the upper horizontally extending part provide a rear upper corner 115T.

The second inclined surface 117A is on the upper horizontally extending part of the outer peripheral edge 115E, and extends frontward and generally horizontally from the rear upper corner 115T. The second inclined surface 117A is a flat surface sloping upward toward the second frame 120.

The second inclined surface 117B is on the rear part of the outer peripheral edge 115E, and extends downward and frontward from the rear upper corner 115T. The second inclined surface 117B is a flat surface sloping diagonally rearward toward the second frame 120. In other words, the second inclined surfaces 117A, 117B are sloped to increase a distance from the axis of the drive shaft 101 toward the second frame 120.

<Operational and Functional Advantages of the First Embodiment>

In the first frame 110 of the belt unit 100 according to the first embodiment, as illustrated in FIGS. 4, 6 and 7, the bearing holder 115 retaining the bearing 150 is positioned closer to the second frame 120 than the facing section 111 is to the second frame 120 in the axial direction. That is, the stepped portion is provided at the boundary BD between the bearing holder 115 and the facing section 111 positioned closer to the side surface 91 than the bearing holder 115 is to the side surface 91.

Specifically, as illustrated in FIG. 6, the stepped portion having the dimension D1 is provided between the facing surface 111K of the facing section 111 and the holding surface 115K of the bearing holder 115. This structure prevents the bearing 150 from protruding outward in the axial direction (in the direction away from the second frame 120) relative to the facing section 111. Hence, the bearing 150 is unlikely to contact terminals 97T (FIG. 3) of the four sets of terminal groups 97 during attachment and detachment of the belt unit 100 to and from the accommodation compartment 90; or, even if the bearing 150 makes contact with the terminals 97T, heavy contact or collision of the bearing 150 with the terminals 97T of each group of terminals 97 can be restrained.

Therefore, according to the belt unit 100 of the first embodiment, damage to each group of terminals 97 for each process cartridge 7 can be restrained upon attachment and detachment of the belt unit 100 to and from the accommodation compartment 90. The image-forming apparatus 1 incorporating the belt unit 100 according to the first embodiment can exhibit the corresponding advantages.

Further, the belt unit 100 of the first embodiment having the stepped structure can have a reduced width in the axial direction, in comparison with a conventional belt unit where a bearing protrudes outward from a flat surface of a first belt frame. Hence, an internal width of the accommodation compartment 90 for accommodating the belt unit 100 can be reduced, rendering the image-forming apparatus 1 more compact.

Further, according to the belt unit 100, as illustrated in FIGS. 6 and 7, the protruding portion 155 of the bearing 150 has a flat plate form extending perpendicularly to the axial direction to cover the end of the drive shaft 101 from the opposite side from the second frame 120, i.e., at the position opposite to the second frame 120 with respect to the first frame 110. With this structure, the protruding portion 155 is unlikely to contact with the terminals 97T of each group of terminals 97, or severe contact or collision of the protruding portion 155 with the terminals 97T of each group of terminals 97 can be restrained. This is in high contrast to imaginary structures where the protruding portion 155 protrudes outward in a rod shape, or one end of the drive shaft 101 is exposed to an outside.

Further, according to the belt unit 100, as illustrated in FIG. 7, the sloped surface 156 formed in the outer peripheral end of the protruding portion 155 can guide travel of the protruding portion 155 without being caught by the terminals 97T of the group of terminals 97. As a result, severe contact or collision of the protruding portion 155 with the terminals 97T of each group of terminals 97 can further be restrained.

Further, according to the belt unit 100, as illustrated in FIG. 6, the distance D155 between the end face of the protruding portion 155 and the second frame 120 is equal to or smaller than the distance between the end face of the rib 114 and the second frame 120, and preferably, the distance D155 is smaller than the distance between the end face of the rib 114 and the second frame 120, and is also smaller than the distance between the facing surface 111K and the second frame 120. With this structure, the entire width of the belt unit 100 is determined exclusively by the distance between the first frame 110 and the second frame 120, regardless of the bearing 150. Accordingly, downsizing of the belt unit 100 in the axial direction can be realized more easily than otherwise.

Further, according to the belt unit 100, as illustrated in FIGS. 7 and 9, the first inclined surface 116 of the bearing holder 115 protrudes outward (away from the second frame 120) in the axial direction to surround the protruding portion 155 of the bearing 150, and is inclined such that the diameter of the first inclined surface 116 is reduced as extending away from the second frame 120 in the axial direction. With this structure, the first inclined surface 116 can smoothly guide the protruding portion 155 to move past the terminals 97T of the group of terminals 97 without being caught by the terminals 97T. As a result, severe contact or collision of the protruding portion 155 with the terminals 97T of each group of terminals 97 can further be restrained.

Further, according to the belt unit 100, the bearing holder 115 has the second inclined surfaces 117A, 117B both of which are inclined toward the second frame 120 on the outer peripheral edge 115E. With this structure, the inclined surfaces 117A, 117B can permit the outer peripheral edge 115E of the bearing holder 115 to be smoothly moved past the terminals 97T of the group of terminals 97 without being caught by the terminals 97T. As a result, severe contact or collision of the outer peripheral edge 115E with the terminals 97T of each group of terminals 97 can further be suppressed, thereby restraining damages to the terminals 97T.

Further, according to the belt unit 100, since the second inclined surfaces 117A, 117B are flat in shape, the second inclined surfaces 117A, 117B can smoothly guide the outer peripheral edge 115E without being caught by the terminals 97T.

Further, according to the belt unit 100, the protruding portion 155 of the bearing 150 made from electrically conductive resin contacts the grounding electrode 98E (FIG. 3) upon accommodation of the belt unit 100 in the accommodation compartment 90. This structure can facilitate transmission of electrical charges from the drive shaft 101, the drive roller 101R, and the endless belt 109 to an earthing route via the bearing 150. As a result, electrification to the drive shaft 101, the drive roller 101R, and the endless belt 109 can be restrained.

Further, according to the belt unit 100, as illustrated in FIG. 4, the charge terminals 103T each electrically connected to the corresponding transfer roller 103R are positioned on the facing section 111 of the first frame 110. Further, in the image-forming apparatus 1 of the first embodiment, as illustrated in FIG. 3, the four power feed electrodes 98P and the grounding electrode 98E are provided on the side surface 91 of the accommodation compartment 90, the four power feed electrodes 98P being configured to be contacted with the charge terminals 103T and the grounding electrode 98E being configured to be contacted with the protruding portion 155 of the bearing 150 upon accommodation of the belt unit 100 in the accommodation compartment 90. That is, the charge terminals 103T and the bearing 150 serving as a part of the earthing route can be collectively and intensively positioned in the first frame 110. As a result, this structure can facilitate collective positioning in the side surface 91 of the electronic component E1 and the wirings those associated with the belt unit 100.

As illustrated in FIG. 3, the positioning portion 99 is provided in the accommodation compartment 90 of the image-forming apparatus 1. Further, as illustrated in FIG. 7, the counterpart positioning portion 119 subjected to positioning by the positioning portion 99 is provided in the bearing holder 115 of the belt unit 100. The counterpart positioning portion 119 protrudes from the lower peripheral end portion of the bearing holder 115 outward in the axial direction away from the second frame 120. In other words, the position of the first frame 110 is not fixed by the bearing 150, but is fixed by the counterpart positioning portion 119 which is a part of the first frame 110. Hence, enhanced accuracy in positioning of the belt unit 100 can be obtained. This is in high contrast to the conventional belt unit where the bearing is used for positioning.

Further, according to the belt unit 100, as illustrated in FIGS. 7 and 9, the counterpart positioning portion 119 has the flat plate shape whose end portion 119E is chamfered. This structure can not only ensure a larger contacting area of the counterpart positioning portion 119 with the positioning portion, but also contribute to reduction in area of the tip end of the counterpart positioning portion 119. As a result, severe contact or collision of the counterpart positioning portion 119 with the terminals 97T of each group of terminals 97 can be restrained, thereby avoiding damages to the terminals 97T.

Further, according to the belt unit 100, as illustrated in FIG. 6, the end face of the counterpart positioning portion 119 is distant from the second frame 120 by the distance D119 which is equal to or shorter than the distance by which the end face of the rib 114 is distant from the second frame 120. Preferably, the distance D119 is shorter than the distance between the end face of the rib 114 and the second frame 120 in the axial direction, and is substantially equal to the distance between the facing surface 111K of the facing section 111 and the second frame 120 in the axial direction. With this structure, the entire width of the belt unit 100 is determined solely by the distance between the first frame 110 and the second frame 120, irrespective of the counterpart positioning portion 119. As a result, reduction in the entire width can further be facilitated.

2. Second Embodiment

Figure 11:
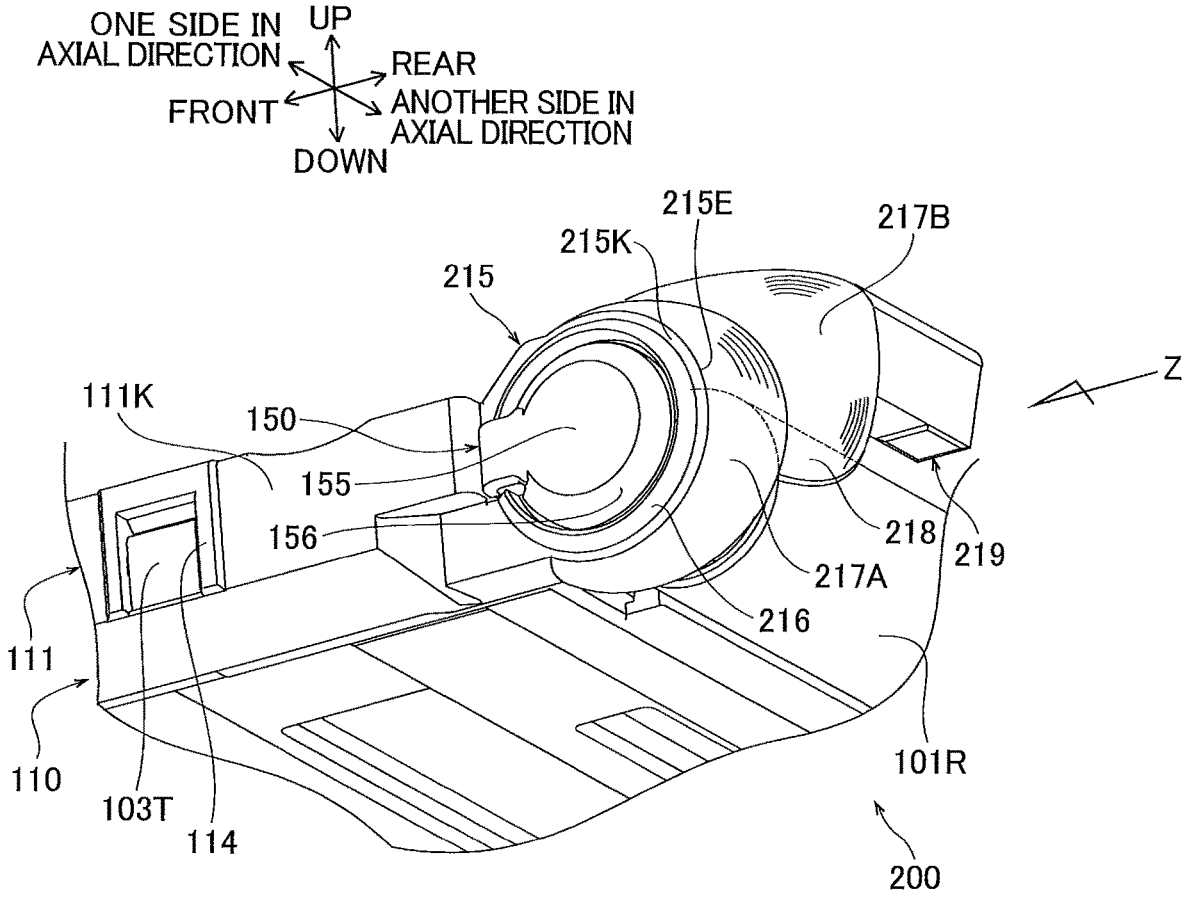
FIG. 11 is a partially enlarged perspective view of a belt unit according to a second embodiment without delineation of the endless belt.

A belt unit 200 according to a second embodiment will next be described with reference to FIG. 11, wherein like parts and components are designated by the same reference numerals as those in the first embodiment.

The belt unit 200 according to the second embodiment is the same as the belt unit 100 according to the first embodiment except that the belt unit 200 includes second inclined surfaces 217A, 217B and a counterpart positioning portion 219, instead of the second inclined surfaces 117A, 117B, and the counterpart positioning portion 119 of the belt unit 100.

In the belt unit 200, a bearing holder 215 is in a frustoconical shape, and has an outer peripheral edge 215E positioned away from the facing section 111 in the frontward/rearward direction. When viewed in the axial direction, the outer peripheral edge 215E has an arcuate shape to extend in the circumferential direction of the drive shaft 101.

The second inclined surface 217A extends from the outer peripheral edge 215E toward the second frame 120. The second inclined surface 217A is curved and inclined to increase a distance from the axis of the drive shaft 101 toward the second frame 120. The second inclined surface 217A also extends in the circumferential direction of the drive shaft 101. The second inclined surface 217A has a bottom edge opposite to the outer peripheral edge 215E.

The second inclined surface 217B is connected to an upper rear portion of the bottom edge of the second inclined surfaces 217A. The second inclined surface 217B is a curved surface that is inclined to increase a distance from the axis of the drive shaft 101 toward the second frame 120.

The second inclined surface 217B is integrally connected to a protecting portion 218. The protecting portion 218 is overlapped with a part of the endless belt 109, the part being positioned adjacent to the one end of the drive shaft 101 as viewed in a direction Z in FIG. 11, i.e., in the frontward/rearward which is coincident with the direction of tensile force applied to the endless belt 109.

The counterpart positioning portion 219 is provided on a lower flat surface of a portion extending in the axial direction from a rear upper edge portion of the second inclined surface 217B toward the second frame 120. Although not illustrated in the drawings, a positioning portion associated with the counterpart positioning portion 219 (corresponding to the positioning portion 99 of the first embodiment) is provided in the accommodation compartment 90. Incidentally, reference numerals 215K and 216 designate a holding surface and a first inclined surface, respectively, those corresponding to the holding surface 115K and the first inclined surface 116 of the first embodiment.

<Operational and Functional Advantages of the Second Embodiment>

According to the belt unit 200 of the second embodiment, similar to the belt unit 100 of the first embodiment, damage to the group of terminals 97 for each process cartridge 7 can be restrained at the time of attachment and detachment of the belt unit 200 to and from the accommodation compartment 90. The same is true with respect to the image-forming apparatus 1 incorporating the belt unit 200.

Further, according to the belt unit 200, similar to the belt unit 100 of the first embodiment, an entire width of the belt unit 200 can be reduced. As a result, the internal width of the accommodation compartment 90 of the image-forming apparatus 1 can be reduced, thereby making the image-forming apparatus 1 as a whole more compact.

Further, according to the belt unit 200, the second inclined surfaces 217A, 217B each having an inclined curved shape can smoothly guide travel of the outer peripheral edge 215E of the bearing holder 215, thereby preventing the outer peripheral edge 215E from being caught by the terminals 97T of the group of terminals 97 on the side surface 91 of the accommodation compartment 90.

Further, according to the belt unit 200, the protecting portion 218 is provided at the second inclined surface 217B at the position overlapping with the endless belt 109 when viewed in the direction Z in which tension is applied to the endless belt 109, i.e., in the frontward/rearward direction. This structure can prevent a part of the endless belt 109 adjacent to the one end of the drive shaft 101 from contacting with ambient components during the attachment and detachment of the belt unit 200 to and from the accommodation compartment 90.

Further, according to the belt unit 200, the counterpart positioning portion 219 does not protrude, from the outer peripheral edge of the bearing holder 215, outward in the axial direction away from the second frame 120. With this structure, the entire width of the belt unit 200 is determined by the distance between the first frame 110 and the second frame 120, regardless of the counterpart positioning portion 219. The entire width of the belt unit 200 can thus be further reduced.

3. Variations and Modifications

Various modifications are conceivable.

For example, in the first embodiment, the end face of the protruding portion 155 is distant from the second frame 120 by the distance D155 which is equal to or shorter than the distance between the end face of the rib 114 and the second frame 120 and which is also equal to or shorter than the distance between the facing surface 111K of the facing section 111 and the second frame 120. However, as a modification, the distance D155 between the end face of the protruding portion 155 and the second frame 120 may be greater than the distance between the facing surface 111K and the second frame 120. Further, the distance D155 between the end face of the protruding portion 155 and the second frame 120 may be greater than the distance between the end face of the rib 114 and the second frame 120. Similar modifications may be applied to the counterpart positioning portion 119.

Further, the present disclosure may also be applied to a multifunction peripheral, a printer, a copying machine, and the like.

While the description has been made in detail with reference to the embodiments, it would be apparent to those skilled in the art that many modifications and variations may be made thereto.

[Remarks]

The belt unit 100, 200 is an example of a belt unit of the disclosure. The process cartridge 7 is an example of a process unit. The accommodation compartment 90 is an example of an accommodation compartment. The drive shaft 101 is an example of a drive shaft. The drive roller 101R is an example of a drive roller. The bearing 150 is an example of a bearing. The driven shaft 102 is an example of a driven shaft. The driven roller 102R is an example of a driven roller. The endless belt 109 is an example of an endless belt. The first frame 110 is an example of a first frame. The second frame 120 is an example of a second frame. The facing section 111 is an example of a facing section of the first frame. The bearing holder 115, 215 is an example of a bearing holder of the first frame. The first inclined surface 116, 216 is an example of a first inclined surface of the bearing holder. The second inclined surfaces 117A, 117B, 217A, 217B are examples of a second inclined surface of the bearing holder. The rib 114 is an example of a convex portion. The counterpart positioning portion 119 is an example of a counterpart positioning portion. The body portion 151 is an example of a body portion of the bearing. The protruding portion 155 is an example of a protruding portion of the bearing. The outer peripheral edge 115E, 215E is an example of an outer peripheral edge of the bearing holder. The transfer roller 103R is an example of a transfer roller. The charge terminal 103T is an example of a charge terminal. The group of terminals 97 is an example of a group of terminals for the process unit. The power feed electrode 98P and grounding electrode 98E are examples of a power feed electrode and a grounding electrode of the accommodation compartment, respectively. The positioning portion 99 is an example of a positioning portion of the accommodation compartment.

What is claimed is:

1. A belt unit detachably mountable in an accommodation compartment of an image-forming apparatus along with a detachable process unit, the belt unit being positioned deeper than the process unit in a state where the belt unit and the process unit are accommodated in the accommodation compartment, the accommodation compartment having an inner side surface on which a group of terminals are provided, the group of terminals being configured to contact the process unit accommodated in the accommodation compartment, the belt unit comprising:

a drive roller;

a drive shaft having an axis defining an axial direction and rotatable together with the drive roller about the axis, the drive shaft having one end portion and another end portion in the axial direction;

a bearing disposed over the one end portion of the drive shaft to rotatably support the one end portion;

a drive gear fixed to the another end portion of the drive shaft;

a driven shaft having one end portion and another end portion in the axial direction;

a driven roller rotatable together with the driven shaft;

an endless belt looped over the drive roller and the driven roller under tension;

a first frame comprising:

a facing section supporting the one end portion of the driven shaft, and configured to face the inner side surface upon accommodation of the belt unit in the accommodation compartment; and a bearing holder holding the bearing and connected to the facing section at a position between the drive shaft and the driven shaft; and a second frame rotatably supporting the another end portion of the drive shaft and the another end portion of the driven shaft, the second frame being spaced away from the first frame in the axial direction, the bearing holder being positioned closer to the second frame than the facing section is to the second frame in the axial direction.

2. The belt unit according to claim 1, wherein the bearing comprises:

a body portion rotatably supporting the one end portion of the drive shaft; and a protruding portion connected to the body portion and extending in a direction perpendicular to the axial direction, the protruding portion protruding outward in the axial direction away from the second frame relative to the bearing holder to cover the one end portion of the drive shaft from outward thereof in the axial direction.

3. The belt unit according to claim 2, wherein the protruding portion has an outer peripheral surface on which a sloped surface is formed, the sloped surface being sloped to increase a distance from the axis of the drive shaft toward the second frame.

4. The belt unit according to claim 1, wherein the first frame further comprises a convex portion having an end face positioned farthest from the second frame in the axial direction among an outer surface of the first frame, and wherein the bearing comprises:

a body portion rotatably supporting the one end portion of the drive shaft; and a protruding portion connected to the body portion and protruding outward in the axial direction away from the second frame relative to the bearing holder, the protruding portion having an end face distant from the second frame in the axial direction by a distance which is equal to or smaller than a distance between the end face of the convex portion and the second frame in the axial direction.

5. The belt unit according to claim 1, wherein the bearing comprises:

a body portion rotatably supporting the one end portion of the drive shaft; and a protruding portion connected to the body portion and protruding outward in the axial direction away from the second frame relative to the bearing holder, and wherein the bearing holder has a first inclined surface protruding outward in the axial direction away from the second frame and extending to surround the protruding portion, the first inclined surface being inclined to increase a distance from the axis of the drive shaft toward the second frame.

6. The belt unit according to claim 1, wherein the bearing holder has:

an outer peripheral edge positioned away from the facing section; and a second inclined surface extending from the outer peripheral edge and inclined to increase a distance from the axis of the drive shaft toward the second frame.

7. The belt unit according to claim 6, wherein the second inclined surface is a flat surface.

8. The belt unit according to claim 6, wherein the second inclined surface is a curved surface.

9. The belt unit according to claim 6, wherein the second inclined surface has a protecting portion provided at a position overlapping with a part of the endless belt as viewed in a direction of a tensile force applied to the endless belt.

10. The belt unit according to claim 1, wherein the bearing is made from electrically conductive resin.

11. The belt unit according to claim 10, further comprising:

a transfer roller rotatably supported by the first frame and the second frame at a position between the drive roller and the driven roller, the transfer roller being in contact with the endless belt; and a charge terminal provided on the facing section of the first frame and electrically connected to the transfer roller, wherein the image-forming apparatus includes a power feed electrode and a grounding electrode both of which are urged to protrude into the accommodation compartment through the inner side surface, the charge terminal contacting the power feed electrode upon accommodation of the belt unit in the accommodation compartment.

12. The belt unit according to claim 11, wherein the first frame further comprises a convex portion surrounding the charge terminal, the convex portion having an end face positioned farthest from the second frame in the axial direction among an outer surface of the first frame.

13. The belt unit according to claim 1, wherein the image-forming apparatus further includes a positioning portion positioned inside the accommodation compartment to fix a position of the belt unit accommodated in the accommodation compartment, wherein the bearing holder has an outer peripheral edge positioned away from the facing section, and wherein the first frame further comprises a counterpart positioning portion configured to seat on the positioning portion upon accommodation of the belt unit in the accommodation compartment, the counterpart positioning portion extending outward in the axial direction away from the second frame from the outer peripheral edge of the bearing holder.

14. The belt unit according to claim 13, wherein the counterpart positioning portion is in a form of a flat plate having a chamfered end face.

15. The belt unit according to claim 13, wherein the first frame further comprises a convex portion having an end face positioned farthest from the second frame in the axial direction among an outer surface of the first frame, and wherein an end face of the counterpart positioning portion is distant from the second frame in the axial direction by a distance which is equal to or smaller than a distance between the end face of the convex portion and the second frame in the axial direction.

16. The belt unit according to claim 1, wherein the facing section and the bearing holder provide a stepped portion therebetween in the first frame.

17. An image-forming apparatus comprising:

the belt unit according to claim 1;

a process unit; and an accommodation compartment configured to detachably accommodate therein the process unit and the belt unit, the belt unit being positioned deeper than the process unit in a state where the belt unit and the process unit are accommodated in the accommodation compartment, the accommodation compartment having an inner side surface on which a group of terminals are provided, the group of terminals being configured to contact the process unit accommodated in the accommodation compartment.

18. The image-forming apparatus according to claim 17, further comprising a power feed electrode and a grounding electrode configured to protrude into the accommodation compartment through the inner side surface, the power feed electrode and the grounding electrode being configured to contact the belt unit accommodated in the accommodation compartment.

19. The image-forming apparatus according to claim 17, further comprising a positioning portion positioned inside the accommodation compartment to fix a position of the belt unit accommodated in the accommodation compartment.

* * * * *